United States Patent [19]

Weatherford

[11] 4,009,739

[45] Mar. 1, 1977

[54] GASOLINE AND VAPOR RETURN HOSE SYSTEM FOR DELIVERY TRUCK

[76] Inventor: Danny J. Weatherford, 7250 N. 41st Ave., Phoenix, Ariz. 85021

[22] Filed: Sept. 2, 1975

[21] Appl. No.: 609,282

[52] U.S. Cl. ..... 141/59; 141/90; 138/114; 222/159; 285/133 R

[51] Int. Cl.[2] ..... B65B 39/04

[58] Field of Search ..... 141/285, 290, 382–386, 141/392, 59, 90, 295, 298, 299, 300; 285/133 R, 133 A; 138/114; 222/159

[56] References Cited

UNITED STATES PATENTS 3,372,715 3/1968 Ashton ..... 285/133 R

*Primary Examiner*—Houston S. Bell, Jr.
*Attorney, Agent, or Firm*—Warren F. B. Lindsley

[57] ABSTRACT

A coaxial hose for the unloading of gasoline from a tank truck, the inner core carrying gasoline to the storage tank and the concentric outer passage carrying vapors which are returned to the truck as they are displaced from the storage tank.

4 Claims, 6 Drawing Figures

GASOLINE AND VAPOR RETURN HOSE SYSTEM FOR DELIVERY TRUCK

BACKGROUND OF THE INVENTION

This invention is directed to improved equipment for unloading gasoline from tank trucks and more particularly to improvements preventing fuel spillage and the loss of gaseous vapors to the atmosphere.

A significant factor in the cost of gasoline to the consumer is the distributor's cost of delivering the gasoline to the local gas stations. The gasoline is delivered by large tank trucks which are specially equipped to permit the safe and efficient handling of this highly volatile and dangerous product. To this capital expense is added the high labor cost of the specially trained drivers and maintenance personnel.

The high cost of the truck and its associated equipment is due in part to provisions which must be made for containing and controlling the volatile vapors which are displaced from the underground tanks as they are filled from the delivery trucks. For reasons of safety and ecology the displaced vapors are returned to the truck as the gasoline flows into the tank. Ordinarily separate hoses are provided for the gasoline and returned fumes.

In the interest of the economy of the delivery operation, it is important that the gasoline be unloaded as quickly as possible so as to make the most efficient use of manpower and equipment. For this reason, the hoses and associated fittings are very large and cumbersome and the handling and connecting of these hoses tax the strength and edurance of the delivery man. This is especially true in the case of some of the more recently introduced equipment where the gasoline and vapor return hoses are coupled together in a paralleled arrangement by means of side-by-side twin fittings. This arrangement increases the time required in connecting and disconnecting the hoses and complicates the operation.

Another problem involved in the unloading operation is the prevention of overflow. If the storage tank is filled before the valve is cut off at the truck, a considerable quantity of gasoline will remain in the hose which must be disposed of before the hose is disconnected to prevent spilling on the ground or pavement. No mechanical provision is provided in the prior art for this function. In the case of the very large hoses employed for rapid unloading, this is an important consideration.

SUMMARY OF THE INVENTION

In accordance with the invention claimed, an improved hose system and associated equipment are provided for use with gasoline tank trucks.

Another object of this invention is to provide in such a hose system a means for returning displaced vapors from the storage tank to the truck as the tank is being filled with gasoline.

A further object of this invention is to provide an improved hose system for gasoline trucks in which the gasoline and return vapors are carried by a single coaxial hose which may be more easily handled and more quickly connected and disconnected than heretofore possible.

A still further object of this invention is to provide along with the hose system on tank fill ups a means for clearing the delivery hose of gasoline before disconnecting the hose from the storage tank.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing, in which.

DESCRIPTION OF THE PREFERRED EMBODIMENT

Figure 1:
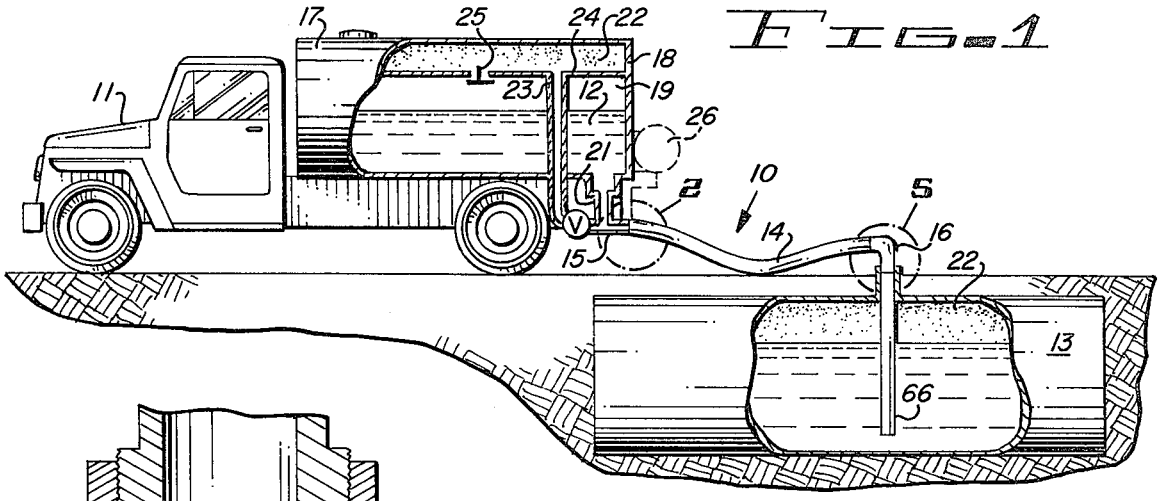
FIG. 1 is a perspective view of a gasoline tank truck unloading gasoline with cutaway sections revealing details of the special hose system embodying the invention.

Referring more particularly to the drawing by characters of reference, FIG. 1 discloses a gasoline and vapor return hose system 10 of the invention in combination with a gasoline tank truck 11 from which gasoline 12 is being unloaded into an underground storage tank 13. The hose system 10 comprises a flexible coaxial hose 14 connected to truck 11 by means of a first hose coupler 15 and to the storage tank 13 by means of a second hose coupler 16.

The truck 11 is equipped with a special tank 17 having a vapor chamber 18 located in the top of the tank and a gasoline chamber 19 occupying the remainder of tank 17. Gasoline 12 from chamber 19 flows to hose 14 through a gasoline delivery port 21 and returning vapors 22 from hose 14 are passed into chamber 18 through a vapor return tube 23.

Located in the horizontal bulkhead 24 separating the vapor chamber 18 from the gasoline chamber 19 is a one-way valve 25 which freely permits the flow of vapor from chamber 18 into chamber 19 as gasoline is unloaded but prevents gasoline from flowing into chamber 18 from chamber 19 during loading operations. An air pressure tank 26 located at the rear of tank 17 is utilized for clearing hose 14 of gasoline after an unloading operation as will be described.

Figure 2:
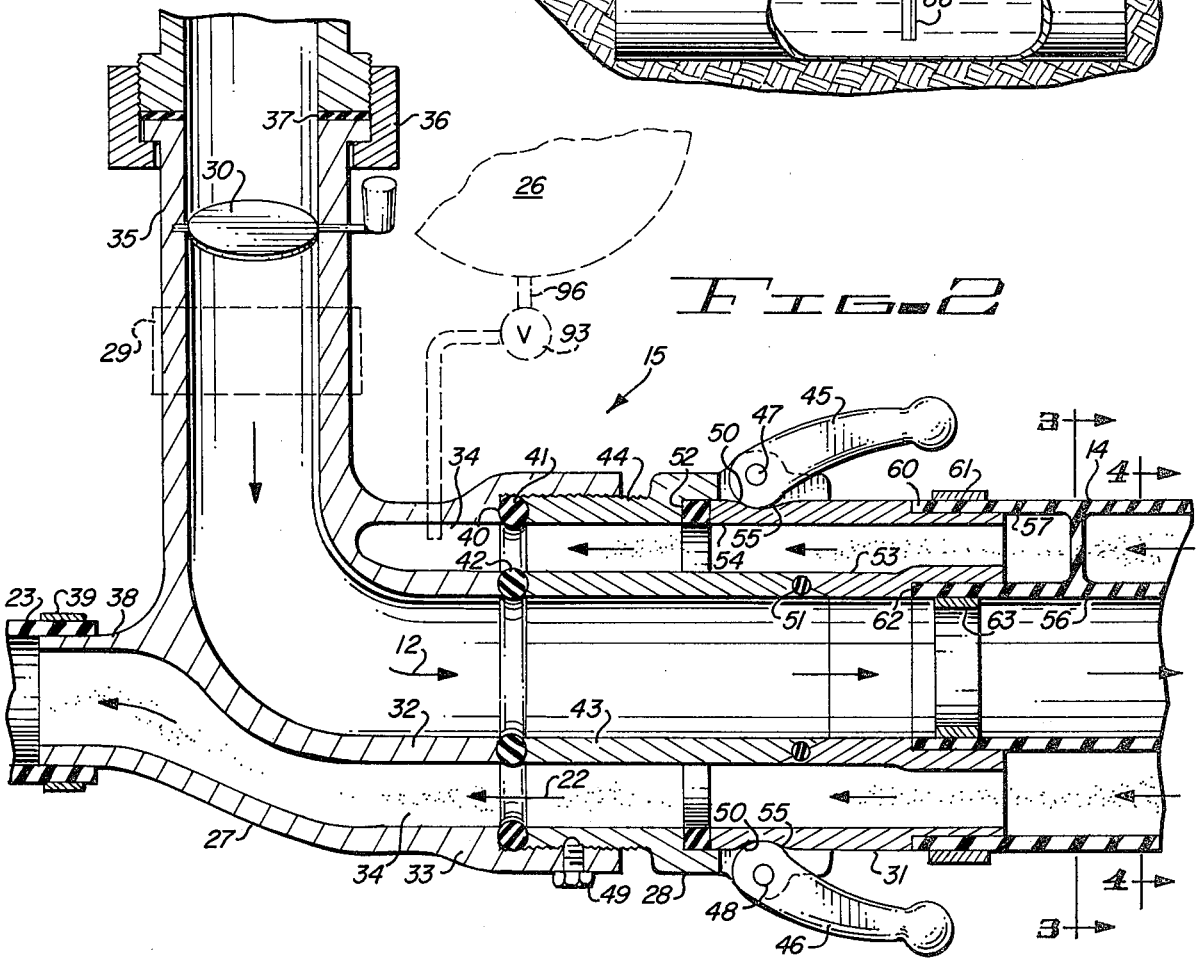
FIG. 2 is an enlarged cross-sectional view of a first hose coupling included in FIG. 1 within the area designated by circle 2.

The first hose coupler 15, as shown in FIG. 2, comprises a transition section 27 a clamping section 28, and an optional window section 29. A hose adaptor 31 attached to the inboard end of the hose 14 mates with section 28.

Transition section 27 adapts the coaxial hose 14, its coaxial adaptor 31 and the coaxial clamping section 28 to the single-channel gasoline delivery port 21 and to the single-channel vapor return tube 23. Section 27 has a coaxial opening formed by concentric cylindrical inner and outer walls 32 and 33, respectively, the inner wall 32 serving as a channel for carrying gasoline 12 and the space between the inner wall 32 and the outer wall 33 serving as a channel 34 for carrying the returning vapors 22. As shown in FIG. 2 the cylindrical inner wall opens upwardly to the left through a right-angle elbow emerging as a single-wall tube 35 which is coupled by means of a conventional screw clamp 36 and a flat neoprene washer 37 to the gasoline deliver port 21. Located at any convenient position along the length of tube 35 is the transparent viewing section 29 which may be incorporated in any of a number of ways such as by means of screws through mating flanges etc. A hand valve 30 is arranged at a suitable place in tube 35 to control the volumn of gasoline 12 flowing through the hose system.

The outer channel 34 funnels off to the left as shown in FIG. 2 into a single-walled cylindrical nipple 38. The end of the vapor return tube 23, preferably a neoprene tube, is slipped over the nipple 38 and is clamped in place by a metal clamp or band 39. Outer wall 33 extends to the right beyond the right end of the inner wall 32, with the inner walls of the right end threaded for connection to clamping section 28. As noted, the threaded end portion has a slightly greater inside diameter than that portion of wall 33 immediately to its left so that a shoulder 40 is formed in alignment with the end of inner wall 32. Shoulder 40 and the end of wall 32 are both cupped or annularly grooved to receive O-ring seals 41 and 42.

Clamping section 28 comprises concentric cylindrical inner and outer walls 43 and 44, respectively, and two cam-type locking levers 45 and 46. Levers 45 and 46 are pivotally mounted on pins 47 and 48 to diametrically opposite points on the clamping section near the right-hand end of outer wall 44. Inner wall 43 is rigidly supported within outer wall 44 by means of longitudinal webs, not shown. The left-hand portion of the outer surface of wall 44 is threaded to mate with the threaded inner surface of wall 33 to permit the coupling of these two parts by turning one into the other. The vertical end surfaces at the left-hand end of walls 43 and 44 are cupped to receive O-rings 41 and 42 when section 28 is threaded into sections 27. A set screw 49 in the rim of wall 33 is tightened against the threaded portion of wall 44 to secure sections 27 and 28 after they have been threaded together.

The right-hand end of inner wall 43 is tapered inwardly and an annular groove at the center of the taper holds a small O-ring 51. Outer wall 44 has a stepped increase in its diameter about midway in its length, its right-hand half having the larger diameter and the step forming a shoulder 52. The pivots 47, 48 of the locking levers 45 and 46 are located midway longitudinally between the left-hand and right-hand ends of the enlarged right half of outer wall 44. Each of the levers 45 and 46 has its pivot pin tangentially aligned with a circumferance of outer wall 44, and the body of the lever 45 and 46 immediately surrounding the pivot pin 47 and 48 is cam-shaped and roughly circular but asymetrical with respect to the pin so that as the lever is rotated toward the right the cam surface 50 moves inward and toward the left.

Hose adaptor 31 comprises concentric cylindrical inner and outer walls 53 and 54, respectively, secured together as a unit by a web structure, not shown. The left-hand end of outer wall 54 is curved perpendicularly while the left-hand end of inner wall 53 is tapered outwardly to mate with the inwardly tapered right-hand end of inner wall 43 of section 28. An annular groove 59 at the center of the outwardly tapered end of wall 53 is appropriately positioned and dimensioned to receive the O-ring 51 and outer wall 54 is dimensioned to fit snugly inside the enlarged right half of section 28. An annular groove 55 encircles the outer surface of wall 54 near the left-hand end of adaptor 31 affording a means to be gripped by the cam surfaces of levers 45 and 46.

Figure 3:
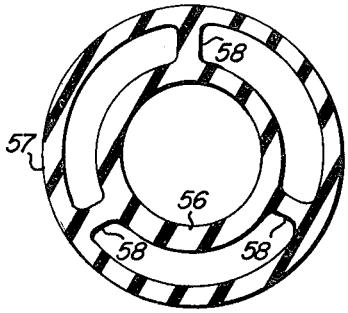
FIG. 3 is a cross-sectional view of the flexible coaxial hose shown in FIG. 2 taken along line 3—3.
Figure 4:
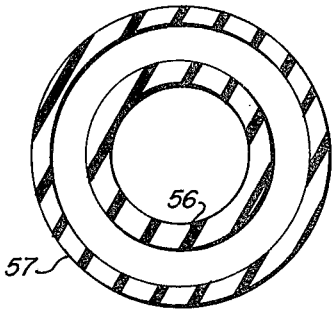
FIG. 4 is a cross-sectional view of the flexible coaxial hose shown in FIG. 2 taken along line 4—4.

The coaxial hose 14 is flexible and preferably made of neoprene which is chemically resistant to gasoline. Its inner and outer walls 56 and 57, respectively, are cylindrical and concentric as shown in FIG. 4 with the inner wall 56 supported within the outer wall 57 by webs 58, as shown in FIG. 3. Webs 58 are spaced at intervals along the length of hose 14. One end of hose 14 is permanently attached to the right-hand end of adaptor 31, its outer wall 57 fitting over an annular depression 60 in the outer surface of outer wall 54 of adaptor 31 where it is secured by a hose clamp or band 61. Its inner wall 56 is fitted inside the right-hand end of inner wall 53 of adaptor 31, i.e. inside an annular depression 62 where it is secured by an expansion band 63.

As suggested in the foregoing description, the inner and outer walls of sections 27 and 28, adaptor 31 and hose 14 are appropriately dimensioned to permit mutual alignment and assembly together which is accomplished as follows:

Section 28 is detachably attached to section 27 by turning the left-hand of section 28 into the right-hand end of section 27 until O-rings 41 and 42 are gripped tightly to form seals against leakage of vapor and gasoline. Set screw 49 is then tightened to secure the connection against loosening due to handling, shock and vibration.

Adaptor 31 which is permanently attached to hose 14 is then inserted in the right-hand end of section 28 and levers 45 and 46 are rotated toward the right. This rotation causes cam surface 50 to sweep inwardly engaging groove 58 of adaptor 31 and forcing adaptor 31 leftwardly against section 28. The left-hand end of outer wall 54 compresses a neoprene washer 61 against shoulder 52 of section 28 and compressing O-ring 51 between the tapered ends of inner walls 43 and 53 again sealing these inner and outer walls against loss of fluid and vapor. The latter connection is the one ordinarily made and broken to connect or disconnect hose 14 from truck 11.

Figure 5:
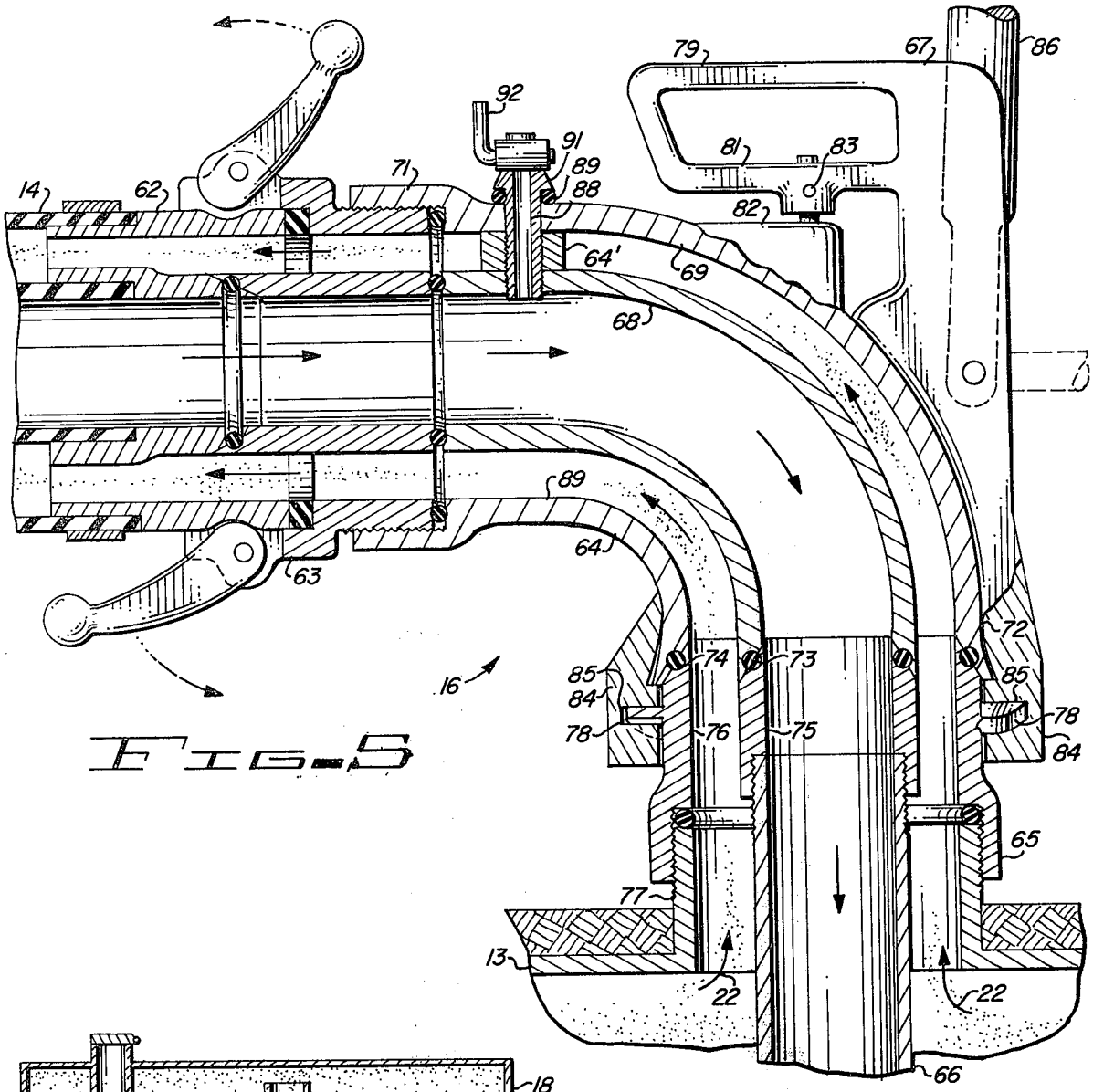
FIG. 5 is an enlarged cross-sectional view of a second hose coupling employed in the invention taken within the circled area 5 of FIG. 1.

The second hose coupler 16, as shown in FIG. 5, comprises a hose adaptor 62 which is identical to hose adaptor 31 of FIG. 2. Clamping section 63 thereof is identical to clamping section 28 of FIG. 2. The adaptor further comprises a coaxial elbow section 64, a tank entry adaptor 65, a gasoline entry tube 66, and a clamping fixture 67.

Coaxial elbow section 64 has concentric inner and outer walls 68 and 69, respectively, formed in the general shape of a ninety-degree elbow, the first end 71 of the elbow is disposed to make connection to the outboard horizontally disposed end of hose 14, and the second end 72 opening downward is arranged for connection to the vertically disposed tank entry adaptor 65. The first end 71 of section 64 is identical to the right-hand end of section 27 of FIG. 2. Section 64 makes connection to section 63 in the same manner that section 27 makes connection to section 28. At end 72 the ends of both inner and outer walls 68 and 69 taper outwardly with the tapered ends of walls 68 and 69 carrying in centered annular grooves inner and outer O-ring seals, 73 and 74, respectively.

Tank entry adaptor 65 has cylindrical coaxial inner and outer walls 75 and 76, respectively, the upper ends of which are tapered inwardly to mate with the outwardly tapered ends of walls 68 and 69. The tapered ends of walls 75 and 76 carry centered annular grooves to receive the O-ring seals 73 and 74 when section 64 and adaptor 65 are brought together as shown in FIG. 5. The lower end of inner wall 75 is threaded on the inside to receive the threaded upper end of cylindrical gasoline entry tube 66. The enlarged lower end of outer wall 76 is also threaded on the inside to receive the threaded filler nipple 77 of storage tank 13. Projecting outwardly from the opposite outer surface of outer wall 76 are two twist lock tabs 78 which are tilted upwardly from the horizontal in a counter-clockwise direction as viewed from above. When tube 66 is threaded into inner wall 75 with outer wall 76 threaded over nipple 77, tube 66 extends well down into the depths of tank 13 as shown in FIG. 1. When a tank is to be regularly filled using the base system 10 of the invention, the adaptor 65 is left in place on the nipple at all times and it is covered by a sealing cap, not shown, between filling operations.

The clamping fixture 67 completely surrounds the lower end of elblow section 64, its upper end carrying a window-frame handle 79. The lower horizontal member 81 of handle 79 is pivotally secured by means of a pin 83 to a projection 82 located on the outer surface of wall 69 of section 64. Pin 83 is aligned with the radial axis of adaptor 65 so that as handle 79 is rotated about pin 83, the lower end of fixture 67 rotates freely about adaptor 65. At the lower end of fixture 67, two projections 84 opening inwardly are aligned with the tabs 78 forming with tabs 78 a twist-lock arrangement which permits the locking of section 64 together with adaptor 65 by the rotation of fixture 67. A handle 86 is pivotally attached to fixture 67 for use during the locking and unlocking operations. In this connection the locking and unlocking normally is made or broken when connecting or disconnecting hose 14 to or from tank 13.

An air vent 88 in the form of a hollow tube passes through a clearance hole in outer wall 69 of section 64, a collar web 64', and penetrates inner wall 68 in a threaded connection. An O-ring seal 89 secured below a shroud 91 near the top of vent 88 seals the clearance hole in wall 69 when vent 88 is threaded into wall 68. The vent is opened or closed by means of a valve 92 at the top of vent 88. Vent 88 is opened to permit the draining of hose 14 when an upstream valve is closed.

When couplers 15 and 16 of FIGS. 2 and 5 are assembled, as described and illustrated in the drawings, gasoline 12 flows from chamber 19 through tube 35, window 29 and thence through an inner channel formed by inner wall 32 of section 27 inside wall 43 of section 28, inner wall 53 of adaptor 31, inner wall 56 of hose 14, inner wall of adaptor 62, inner wall 68 of section 64, inner wall 75 of adaptor 65 and tube 66 into the bottom of tank 13. The displaced vapors 22 flow from the top of tank 13 upwardly through an outer channel formed between the concentric inner and outer walls of adaptor 65, section 64, section 63, adaptor 62, hose 14, adaptor 31, section 28, section 27, thence through nipple 38, tube 23 and into chamber 18 of tank 17 and through valve 25 into chamber 19 to fill the void left by discharged gasoline 12.

Occasionally tank 13 will be completely filled before the operator realized it and there will be no more room left in tank 13 to receive the gasoline remaining in hose 14. Under this condition, the remaining gasoline would be spilled on the ground or pavement if hose 14 were to be disconnected.

Figure 6:
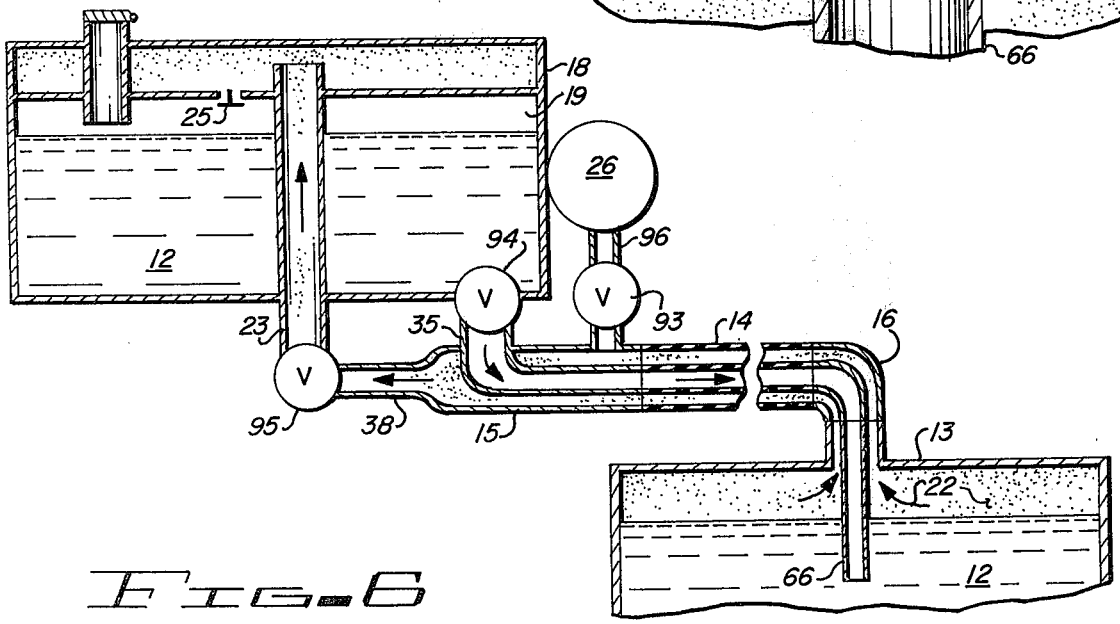
FIG. 6 is a functional diagram illustrating a pressurizing system which is utilized in conjunction with the hose system of the invention for clearing the hoses prior to disconnection from the storage tank on tank fill ups.

FIG. 6 illustrates a means for clearing the hose 14 prior to disconnection from tank 13. This means includes tank 26 and valves 93, 94 and 95. Valve 93 is located in a line 96 connecting tank 26 to the inner channel of coupler 15. Valve 94 is located in tube 35 of coupler 15 with valve 95 located in tube 23. During the unloading operation, valve 93 is closed and valves 94 and 95 are open. When it is discovered that tank 13 is full, valve 95 is closed and the valve 93 is opened and the high pressure in tank 26 then forces air into the inner channels of coupler 16 displacing gasoline upward through valve 94 into chamber 12 and downwardly into tank 13 with excess gasoline being returned from tank 13 via the inner channels of coupler 35. Once this clearing operation has been completed, valves 93, 94 and 95 are closed and hose 14 may be disconnected without the loss of gasoline.

A complete and effective hose system 10 has thus been described which permits the unloading of gasoline and the containment and collection of displaced vapors in accordance with the object of this invention.

The coaxial hose 14 is lighter in weight than a comparable pair of single hoses because the coaxial construction permits the use of a light-weight inner wall 56 which is protected against damage by abrasion by the heavier outer wall 57.

Because of the higher total weight the coaxial hose 14 is easier to handle and to connect or disconnect than a comparable linked pair of single-wall hoses designed for the same rate of flow.

In addition, the coaxial hose 14 may be more quickly connected and disconnected than either the two separate hoses or the linked pair of single-wall hoses so that a substantial economic advantage is realized in terms of capital and labor expenses.

Finally, the coaxial hose structure 14 has been provided in a form which readily permits the clearing of gasoline from the hose prior to disconnecting from the storage tank so that spillage of gasoline is effectively prevented.

It should be noted that the couplers such as the transistion section 27 and the adaptor 65 as well as any other parts of the system disclosed may be formed of aluminum or other suitable light weight material to reduce the weight of the hose system that has to be handled by the driver of the delivery truck.

Although but a single embodiment of the present invention has been illustrated and described, it will be apparent to those skilled in the art that various changes and modifications may be made therein without departing from the spirit of the invention or from the scope of the appended claims.

What is claimed is:

1. A volatilizable liquid fuel and vapor return hose system for delivery trucks comprising:

a flexible hose having coaxially arranged fluid conducting passageways extending along substantially its full length, the inner one of said passageways provided for carrying a volatilizable liquid fuel and the outer one of said passageways carrying vapors of said fuel, a first hose coupler for one end of said hose, a second hose coupler for the other end of said hose, said first coupler comprising a transition section connectable to a fuel delivery port of the truck for connecting said inner one of said passageways to the truck's liquid fuel compartment and said outer one of said passageways to a vapor return tube of the truck connectable to said liquid fuel compartment of the truck, said second coupler comprising a storage tank entry adaptor having an entry tube for extending a predetermined distance into the storage tank and connectable to said inner one of said passageways and a vapor exhaust opening coaxially arranged adjacent said entry tube and connectable to said outer one of said passageways for exhausting vapors from said storage tank as it fills with liquid, and a pair of detachable clamping members one mounted at each end of said hose for engaging with said first coupler at one end of the hose for connecting said one of said passageways to the liquid fuel compartment of the truck and the other passageway to the vapor return tube of the truck, and the other end of said hose to said second coupler for connecting said entry tube to said one of said passageways and said vapor exhaust opening to the other of said pasageways, and means for connecting a source of air under pressure to said inner one of said passageways for clearing the passageway of fuel before disconnecting said clamping members from said first and second couplers after a fuel delivery procedure.

2. The volatilizable liquid fuel and vapor return hose system set forth in claim 1 wherein:

said pair of detachable clamping members mounted at each end of said hose telescopically engage with said first and second couplers.

3. The volatilizable liquid fuel and vapor return hose system set forth in claim 1 in further combination with:

a source of air under pressure connected to said means.

4. The volatilizable liquid fuel and vapor return hose system set forth in claim 1 in further combination with:

a transparent hose section connected between said first coupler and the fuel delivery port of the truck.

* * * * *